US011959245B2

(12) United States Patent
Rudyan et al.

(10) Patent No.: US 11,959,245 B2
(45) Date of Patent: Apr. 16, 2024

(54) INJECTABLE TIE BACK COVER FOR WATERPROOFING, APPARATUS, AND A METHOD OF USING SAME

(71) Applicant: Amir Rudyan, Canoga Park, CA (US)

(72) Inventors: Amir Rudyan, Agoura Hills, CA (US); Paul Thomas Miller, Valencia, CA (US); Bradford Stare, St. Charles, IL (US); Vincent Caserta, Bronx, NY (US)

(73) Assignee: Amir Rudyan, Canoga Park, CA (US)

( * ) Notice: Subject to any disclaimer, the term of this patent is extended or adjusted under 35 U.S.C. 154(b) by 451 days.

(21) Appl. No.: 17/170,853

(22) Filed: Feb. 8, 2021

(65) Prior Publication Data

US 2022/0251799 A1 Aug. 11, 2022

(51) Int. Cl.
*E02D 29/02* (2006.01)
*E02D 5/80* (2006.01)
*E02D 31/02* (2006.01)

(52) U.S. Cl.
CPC ..... *E02D 31/02* (2013.01); *E02D 29/0275* (2013.01); *E02D 29/0283* (2013.01); *E02D 2250/003* (2013.01); *E02D 2300/0006* (2013.01); *E02D 2300/002* (2013.01); *E02D 2300/0026* (2013.01); *E02D 2300/0045* (2013.01); *E02D 2600/30* (2013.01)

(58) Field of Classification Search
CPC . E02D 31/02; E02D 29/0233; E02D 29/0266; E02D 29/0275; E02D 29/0283; E02D 2600/30; E02D 2250/003; E02D 2300/0006; E02D 2300/002; E02D 2300/0026; E02D 2300/0045
See application file for complete search history.

(56) References Cited

U.S. PATENT DOCUMENTS 2,524,419 A * 10/1950 Billner ..... B28B 7/46 264/102
5,063,006 A * 11/1991 Tahara ..... E04G 23/0211 425/13

FOREIGN PATENT DOCUMENTS

EP 169170 A * 1/1986 ..... E04G 23/0203
JP 2013256797 A * 12/2013
KR 867414 B1 * 11/2008
(Continued)

*Primary Examiner* — Benjamin F Fiorello
*Assistant Examiner* — Stacy N Lawson
(74) *Attorney, Agent, or Firm* — Aziz M. Ahsan; AHSAN& ASSOCIATES, PLLC

(57) ABSTRACT

The present invention relates generally to an injectable tie back cover for waterproofing, apparatus, and a method of using same. The invention encompasses a substantially domed shaped structure having at least one surface along the domed shaped structure, and having an edge flanged surface which is placed over a tieback head, and where the injectable tieback cover is used as a waterproofing apparatus. A supplemental injectable tubing can also be provided around the outside of the substantially domed shaped structure, which injectable tubing can be injected with a secondary waterproofing material to provide additional waterproofing to the area around the injectable tie back cover facing the concrete or shotcrete. The domed shaped structure can also have at least one dome channel to accommodate at least one injectable tieback cover tubing. The invention also provides a method of using the inventive injectable tie back cover for waterproofing structures.

20 Claims, 7 Drawing Sheets

(56) References Cited

FOREIGN PATENT DOCUMENTS

| | | | | | |
|---|---|---|---|---|---|
| KR | 2019018263 | A | * | 2/2019 | E04C 5/12 |
| KR | 2020041095 | A | * | 4/2020 | E02D 5/80 |
| WO | WO-2018223158 | A1 | * | 12/2018 | E02D 5/80 |

* cited by examiner

INJECTABLE TIE BACK COVER FOR WATERPROOFING, APPARATUS, AND A METHOD OF USING SAME

FIELD OF THE INVENTION

The present invention relates generally to an injectable tie back cover for waterproofing, apparatus, and a method of using same. The invention encompasses a substantially domed shaped structure having at least one surface along the domed shaped structure, and having an edge flanged surface which is placed over a tieback head, and where the injectable tieback cover is used as a waterproofing apparatus. A supplemental injectable tubing can also be provided around the outside of the substantially domed shaped structure, which injectable tubing can be injected with a secondary waterproofing material to provide additional waterproofing to the area around the injectable tie back cover facing the concrete or shotcrete. The domed shaped structure can also have at least one dome channel to accommodate at least one injectable tieback cover tubing. The invention also provides a method of using the inventive injectable tie back cover for waterproofing structures.

BACKGROUND INFORMATION

Tieback covers have been used in the building industry for a number of years and they are used to protect or cover the tieback heads that are used to secure the wall to the earth or soil. The tieback covers typically have a dome shaped center area with a flat base. The tieback covers can be installed over both cable and rod type tieback heads. The tieback cover is basically installed over the tieback head with the perimeter base mechanically fastened or anchored to the soil retention system or lagging using mechanical fasteners so as to provide a quick and easy detailing aid prior to the application of a waterproofing membrane system, and the application of concrete or shotcrete.

Tie-back covers are pre-formed, using high-impact resistant, heavy-duty thermoplastic material, such as, a high-impact ABS plastic, as ABS (Acrylonitrile Butadiene Styrene) is a common thermoplastic polymer. The tieback covers are used protect the waterproofing membrane integrity at the soil retention tieback systems. The tieback covers have to be strong so as to withstand the placement of concrete or shotcrete.

This invention improves on the deficiencies of the prior art and provides an inventive injectable tie back cover for waterproofing, apparatus, and a method of using same.

PURPOSES AND SUMMARY OF THE INVENTION

The invention is a novel injectable tie back cover for waterproofing, apparatus, and a method of using same.

Therefore, one purpose of this invention is to provide an injectable tie back cover for waterproofing, apparatus, and a method of using same.

Another purpose of this invention is to provide a substantially domed shaped structure having an edge flanged surface which is placed over a tieback head, and where the substantially domed shaped structure is used as a waterproofing apparatus.

Yet another purpose of this invention is to provide a supplemental injectable tubing around the outside of the substantially domed shaped structure, which tubing can be injected with a secondary waterproofing material so as to provide additional waterproofing to the area around the tie back head.

Still yet another purpose of this invention is to provide a domed shaped structure with at least one dome channel to accommodate at least one injectable tieback cover tubing.

Still yet another purpose of this invention is to provide continuous waterproofing over irregular surfaces such as tie back cover heads, bolts, etc.

Therefore, in one aspect this invention comprises an injectable tie back cover apparatus for waterproofing, comprising:

(a) a hollow dome having an outer surface, an inner surface, and a peripheral edge surface;

(b) a base having an upper surface, a lower surface, an outer peripheral edge, an internal opening having an inner peripheral edge, and wherein said inner peripheral edge of said base is secured to said peripheral edge surface of said dome; and (c) said outer surface of said hollow dome having at least one dome channel around at least a portion of said outer surface of said hollow dome.

In another aspect this invention comprises an injectable tie back cover apparatus for waterproofing for a wall, comprising:

(a) at least one soil retention system having a first face and a second face, and wherein said first face faces compacted earth or soil;

(b) a wall having a first face, and a second face, and wherein said first face is secured to at least a portion of said second face of said at least one soil retention system;

(c) a hollow dome having an outer surface, an inner surface, and a peripheral edge surface;

(d) a base having an upper surface, a lower surface, an outer peripheral edge, and an interior opening having an inner peripheral edge, and wherein said inner peripheral edge of said base is secured to said peripheral edge surface of said dome;

(e) said outer surface of said hollow dome having at least one dome channel around at least a portion of said outer surface of said hollow dome;

(f) at least one injection tube having a first end, and a second end;

(g) a first tube elbow having a first end, and a second end;

(h) a second tube elbow having a first end and a second end;

(i) a first feeder tube having a first end, and a second end;

(j) a second feeder tube having a first end and a second end, and wherein said first end of said injection tube is secured to said first end of said first tube elbow, and said second end of said injection tube is secured to said first end of said second tube elbow, and at least a portion of said at least one injection tube is placed inside at least a portion of said at least one dome channel; and wherein said first end of said first feeder tube is secured to said second end of said first tube elbow, and said first end of said second feeder tube is secured to said second end of said second tube elbow.

DETAILED DESCRIPTION

Figure 1A:
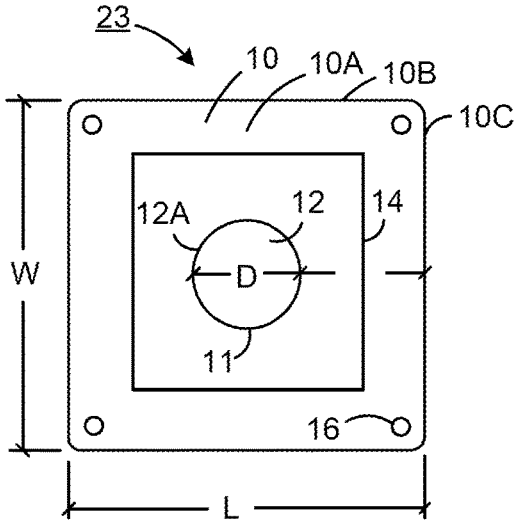
FIGS. 1A, 1B, and 1C, illustrate a top, side, and perspective view, respectively, of an inventive injectable tie back cover according to a first embodiment of the invention.

The inventive injectable tie back cover apparatus and a method of using same will now be discussed with reference to FIGS. 1A through 14. Although the scope of the present invention is much broader than any particular embodiment, a detailed description of the preferred embodiment follows together with drawings. These drawings are for illustration purposes only and are not drawn to scale. Like numbers represent like features and components in the drawings.

Figure 1B:
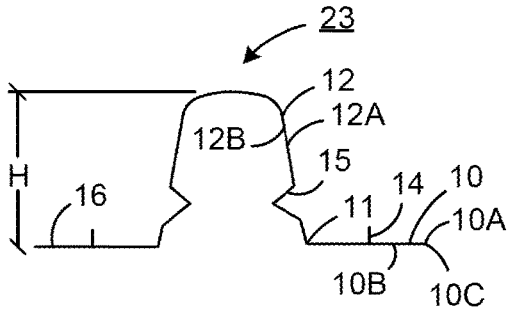
Figure 1C:
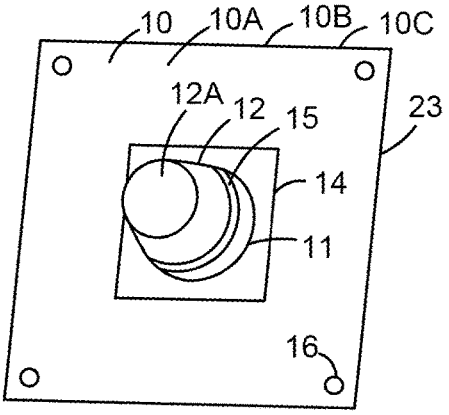

FIGS. 1A, 1B, and 1C, illustrate a top, side, and perspective view, respectively, of an inventive injectable tie back cover 23, according to a first embodiment of the invention. The inventive injectable tie back cover 23, comprises of a base 10, having a first or upper or top base surface 10A, a second or bottom base surface 10B, a base edge 10C, and having a substantially hollow dome 12, connected to the base 10, around an area 11, or dome base 11. The base 10, has a base width "W", a base length "L". The base length "L", could be the same as the base width "W", or it could be different. The substantially hollow dome 12, has a first or an outer surface 12A, and a second or an inner surface 12B. For most applications it is preferred that the substantially hollow dome 12, around an area 11, or dome base 11, is connected to the top surface 10A, and the bottom surface 10B, and projecting substantially in an outward or upward direction. For some applications it is preferred that the base 10, has a plurality of openings or holes 16, preferably along the peripheral edges of the base 10, so as to secure the inventive injectable tie back cover 23, to another structure, such as, for example, wood lagging 42, and/or retainer 44, shown in FIG. 3. For most applications it is preferred that the hollow dome 12, has a diameter "D", height "H", and is substantially at the center of the base 10. The hollow dome 12, has at least one dome gutter 15, or dome channel 15, on the outer surface 12A, of the hollow dome 12. For some applications the base 10, could also have at least one mini-wall 14, or protrusion 14, between the base edge 10C, and the dome base 11.

Figure 2A:
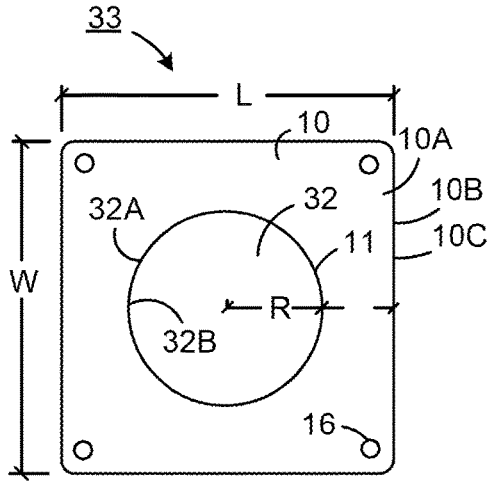
FIGS. 2A, 2B, and 2C, illustrate a top, side, and perspective view, respectively, of an inventive injectable tie back cover according to a second embodiment of the invention.
Figure 2B:
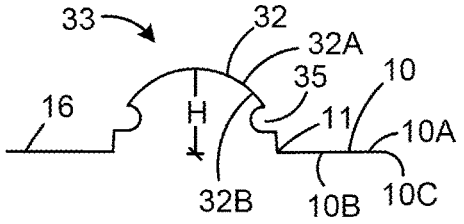
Figure 2C:
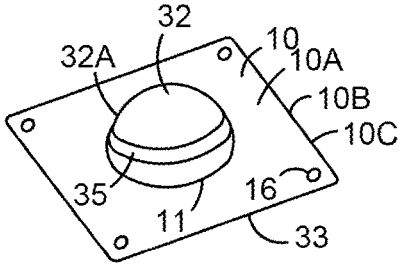

FIGS. 2A, 2B, and 2C, illustrate a top, side, and perspective view, respectively, of an inventive injectable tie back cover 33, according to a second embodiment of the invention. The inventive injectable tie back cover 33, comprises of a base 10, having a first or upper or top base surface 10A, a second or bottom base surface 10B, a base edge 10C, and having a substantially hollow dome 32, connected to the base 10, around an area 11, or dome base 11. The substantially hollow dome 32, has a first or an outer surface 32A, and a second or an inner surface 32B. For most applications it is preferred that the substantially hollow dome 32, around an area 11, or dome base 11, is connected to the top surface 10A, and the bottom surface 10B, and projecting substantially in an outward or upward direction. For some applications it is preferred that the base 10, has a plurality of openings or holes 16, preferably along the peripheral edges of the base 10, so as to secure the inventive injectable tie back cover 33, to another structure, such as, for example, wood lagging 42, and/or retainer 44, shown in FIG. 3. For most applications it is preferred that the hollow dome 32, has a height H, radius R, and is substantially at the center of the base 10. The hollow dome 32, has at least one dome cut 35, or dome groove 35, on the outer surface 32A, of the hollow dome 32.

Figure 3:
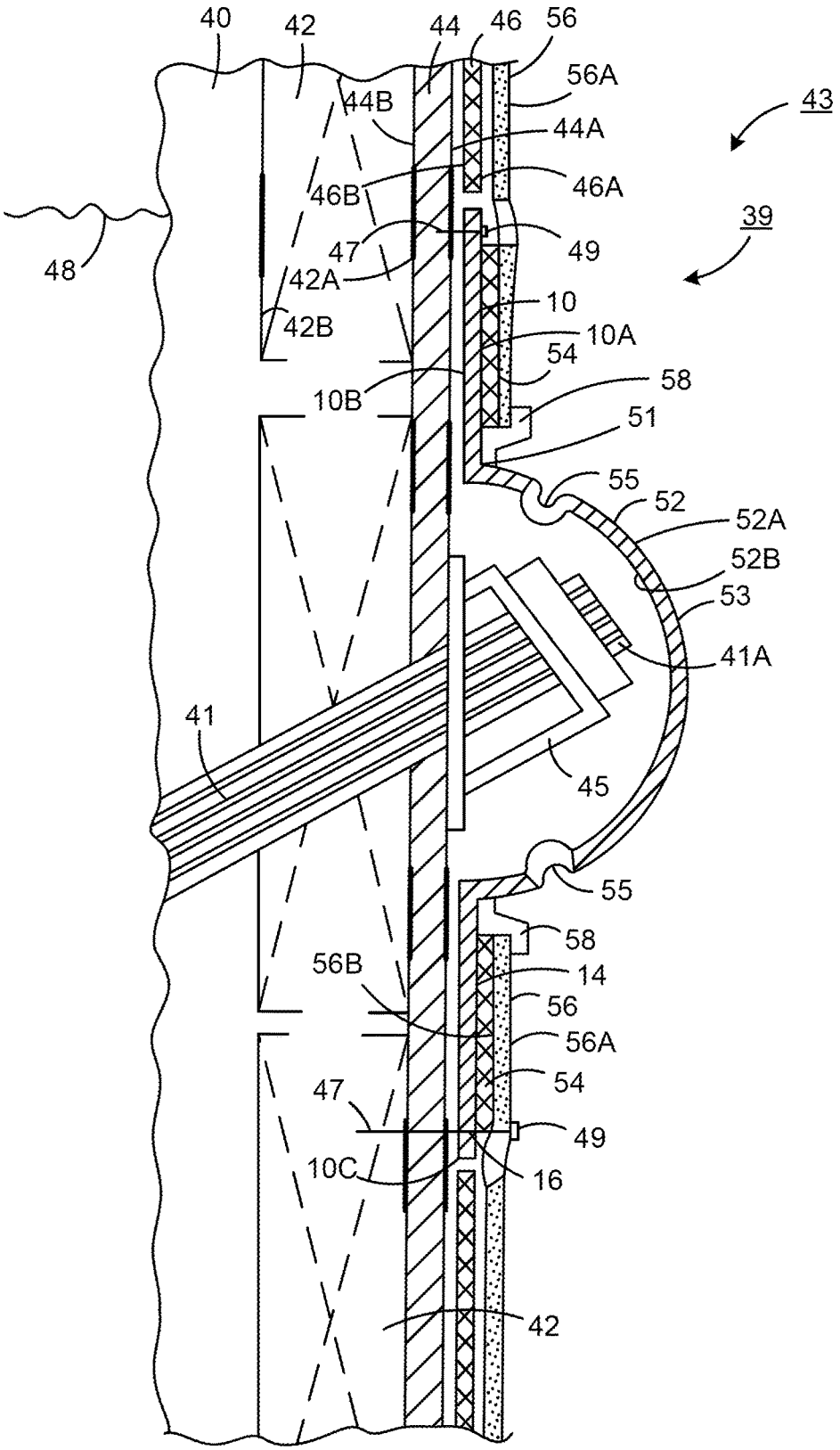
FIG. 3, illustrate a side view of an inventive injectable tie back cover according to a third embodiment of the invention, after being secured to a wall.

FIG. 3, illustrate a side view of an inventive injectable tie back cover 53, according to a third embodiment 43, of the invention, after being secured to a wall 39. The inventive injectable tie back cover 53, comprises of a round or circular base 10, having a first or upper or top base surface 10A, a second or bottom base surface 10B, a round or circular base edge 10C, and having a substantially hollow dome 52, connected to the base 10, around an area 51, or dome base 51. The substantially hollow dome 52, has a first or an outer surface 52A, a second or an inner surface 52B, a dome base 51, and at least one dome channel 55. The wall 39, is made by pushing or excavating soil or earth 40, and placing at least one retaining means 42, having a first surface 42A, and a second surface 42B, against the surface of the soil or earth 40, such that the second surface 42B, is in direct and secure contact with the soil or earth 40. On the exposed surface 42A, of the at least one retaining means 42, one could place a retainer 44, having a first surface 44A, and a second surface 44B. For some applications one could also put at least one drain board 46, having a first surface 46A, and a second surface 46B, against the exposed surface 44A, of the at least one retainer 44. As one can see that the anchoring wires or rods or cables 41, are anchored to the soil or earth 40, at one end and are exposed at the opposite end as tieback head 41A. For most applications the anchoring rods 41, at the exposed end or tieback head 41A, are retained or secured to or against the retainer 44, using at least one tieback nut or bolt 45. As one can see in FIG. 3, that the tieback head 41A, along with the tie back nut/bolt 45, are extending out or above the planar surface of the wall 39, and thus creating an uneven surface for the wall 39, and also an unprotected surface between the wall 39, and the water 48, and thus the need for the inventive injectable tie back cover 53. Furthermore, as one can clearly see that the anchoring rods 41, at the exposed end or tieback head 41A, and retained or secured to the retainer 44, substantially protrude in an outwardly direction from the surface plane of the retainer 44, and therefore in order to protect the tieback head 41A, and the tieback nut or bolt 45, one needs to place a protective apparatus, such as, for example, the hollow dome 52, over it. The substantially hollow dome 52, is then secured to at least one retaining means 42, and/or retainer 44, using at least one securing means 47, which are passed through the openings or holes 16, in the base 10. It is preferred that the securing means 47, has a head 49, which head 49, is secured to or rests against the outer surface 10A, of the base 10. Thus, as one can see that the inventive tie back cover 53, has a base 10, such that the inner surface 10B, of the base 10, is securely and directly in contact with the exposed surface 44A, of the retainer 44. The next step would be to secure at least one skin membrane 56, having a first or top or outer surface 56A, and a second or bottom or inner surface 56B, to the outer surface 10A, of the base 10, using at least one securing means 54, such as, for example, a double-sided adhesive tape 54, glue 54, epoxy 54, and combinations thereof, to name a few. It is preferred that the at least one skin membrane 56, is a puncture resistant waterproofing sheet membrane 56. The at least one skin membrane 56, should preferably have at least one coating of at least one material to aid in creating an excellent adhesion between the skin membrane 56, and a wet concrete 60, or shotcrete 60. In order to further protect the inventive tie back cover 53, one could also place or secure at least one first or primary securing means 58, around the dome base 51, or between the dome channel 55, and the skin membrane 56, such as, for example, at least one first or primary sealant 58. For some applications the at least one securing means 47, could also be used after the placement of the at least one skin membrane 56, and in that situation the head 49, of the securing means 47, would be resting or secured to the exposed surface 56A, of the at least one skin membrane 56. FIG. 3, also shows that the soil or earth 40, has water 48, or moisture 48, or water table 48, which would require waterproofing of the wall 39, so as to prevent the water 48, or moisture 48, from entering through the wall 39, and into a dwelling or building which houses the wall 39.

Figure 4:
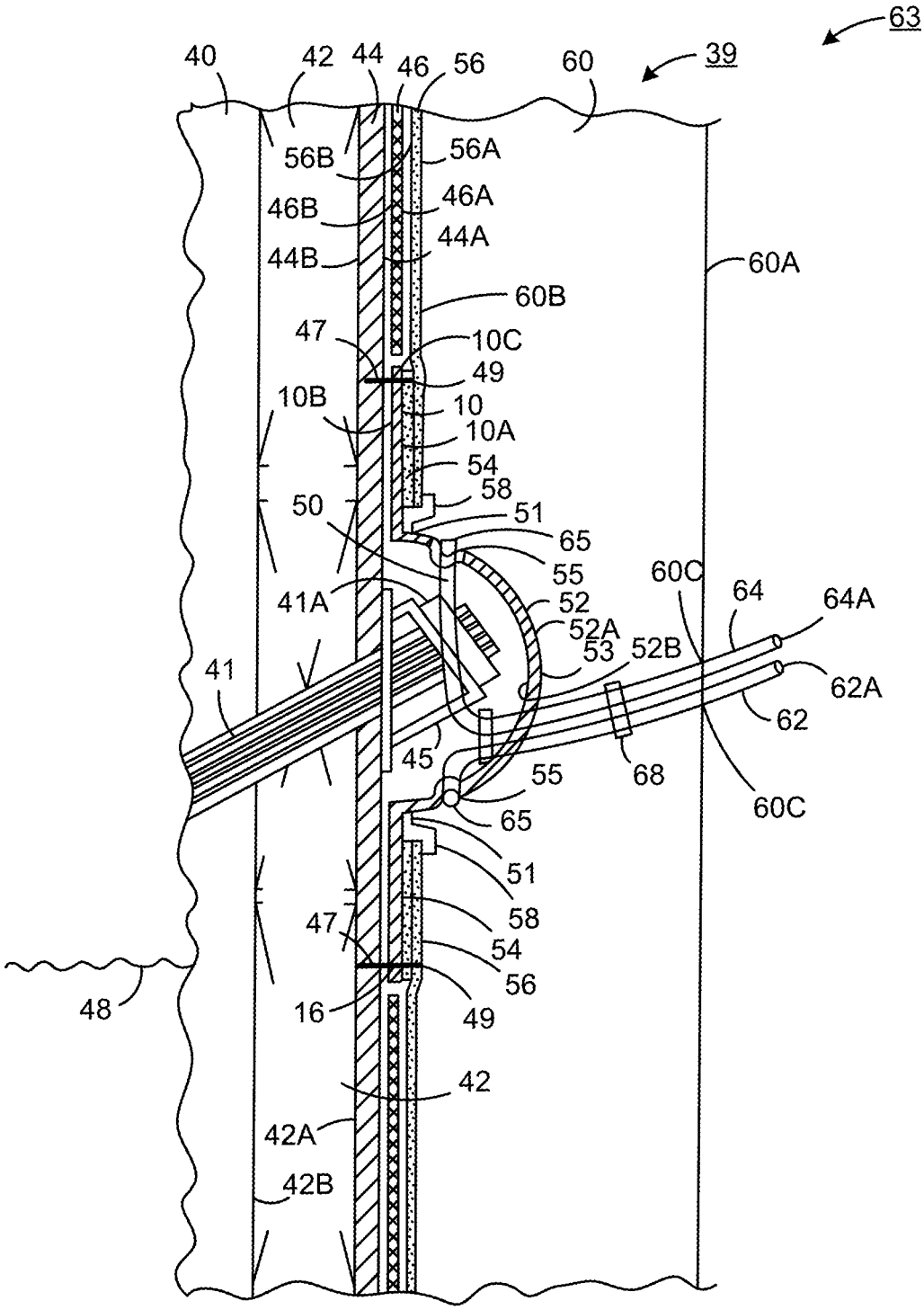
FIG. 4, illustrate a side view of an inventive injectable tie back cover according to a fourth embodiment of the invention, after being secured to a wall, and the application of shotcrete or concrete.

FIG. 4, illustrate a side view of an inventive injectable tie back cover 53, according to a fourth embodiment of the invention 63, after being secured to a wall 39, and the application or placement of concrete 60, or shotcrete 60. The inventive injectable tie back cover tubing 50, comprises of at least one injection tube 65, or injectable tubing 65, where each end has been mated or secured to a tube or feeder tube 62, 64. After the inventive injectable tie back cover 53, has been secured to the wall 39, using at least one securing means 47, one would tie or place at least one inventive injection tube 65, or injectable tubing 65, around the dome channel 55, and mate the two ends of the least one inventive injection tube 65, with the two feeder tubes 62, 64. The feeder tubes 62, 64, have a first or open end 62A, 64A, respectively, and a second or joining end 62B, 64B, respectively, which are mated or secured to each end of the inventive injection tube 65. Optionally, the two feeder tubes 62, 64, can be tied at several places using at least one tie 68, so that the two feeder tubes 62, 64, stay together, while the inventive injection tube 65, fits snugly, or is secured around the at least one dome channel 55. The tube ends 62A, 64A, of the two feeder tubes 62, 64, can now be positioned to stay together, and can be properly positioned during any subsequent operation, such as, for example, not to get buried during, for example, the application of concrete 60, or shotcrete 60. To prevent any concrete 60, or shotcrete 60, from entering the open ends 62A, 64A, of the feeder tube 62, 64, one could wrap a temporary tape or protection means (not shown), at the open ends 62A, 64A. The next step would be to apply concrete 60, or shotcrete 60, against the wall 39, or the exposed surface 56A, of the skin membrane 56, and the outer surface 52A, of the inventive injectable tie back cover 53. Once placed the concrete 60, or shotcrete 60, has a first or outer face or surface 60A, and a second or inner face or surface 60B. At least a portion of the first surface 46A, of the drain board 46, is in secure contact with at least a portion of the second surface 56B, of the at least one skin membrane 56. And, at least a portion of the first surface 56A, of the at least one skin membrane 56, is in secure contact with at least a portion of the second surface 60B, of the concrete 60, or shotcrete 60. Care should be taken that the two feeder tubes 62, 64, do not get buried during the application of the concrete 60, or shotcrete 60, inside the concrete 60, or shotcrete 60, and that the open ends 62A, 64A, of the two feeder tubes 62, 64, stick out of the outer or exposed surface 60A, of the concrete 60, or shotcrete 60. The open ends 62A, 64A, of the two feeder tubes 62, 64, that are sticking out of the outer or exposed surface 60A, of the concrete 60, or shotcrete 60, can be trimmed or covered or hidden by a user as desired. It should be appreciated that the tube ends 62A, 64A, extend outwardly from the concrete/shotcrete surface 60A, via at least one hole or opening 60C.

Figure 5:
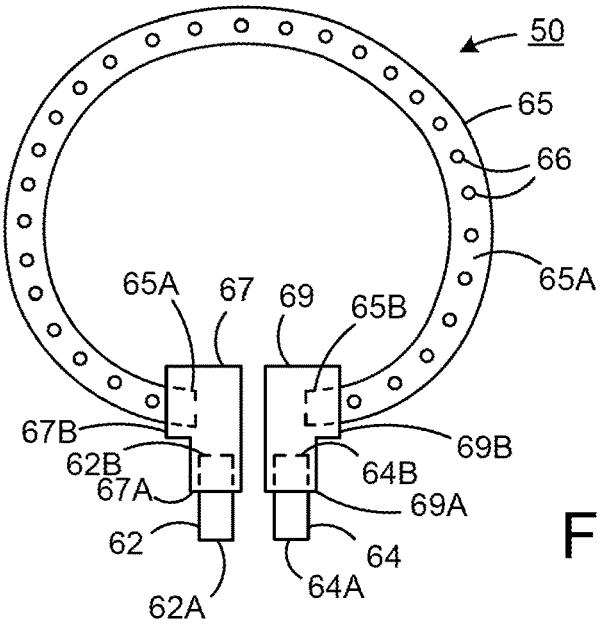
FIG. 5, illustrate a top view of an inventive injectable tie back cover tubing according to a fifth embodiment of the invention.

FIG. 5, illustrate a top view of an inventive injectable tie back cover tubing 50, according to a fifth embodiment of the invention. The inventive injectable tie back cover tubing 50, comprises of at least one injection tube or hose 65, or an injectable tubing or hose 65, having a plurality of openings 66, or cracks 66, or holes 66, or porous features 66, to name a few, and a first tube end 65A, and a second tube end 65B. It should be understood that the inventive injectable tubing 65, has a hollow interior for the easy passage of at least one secondary sealant material 71, shown in FIG. 6. Each of the ends 65A, 65B, are joined or mated with the second end 62B, 64B, of the feeder tube 62, 64, respectively. For some applications one could use two elbows 67, 69, to help in the mating or joining of the open ends 65A, 65B, of the inventive injectable tubing 65, to the second end 62B, 64B, of the feeder tube 62, 64, respectively. The first elbow 67, has a first opening 67A, that mates with the second end 62B, of the feeder tube 62, and a second opening 67B, that mates with the first opening 65A, of the inventive injectable tubing 65. The second elbow 69, has a first opening 69A, that mates with the second end 64B, of the feeder tube 64, and a second opening 69B, that mates with the second opening 65B, of the inventive injectable tubing 65. For some applications, the elbows 67, 69, could be elbows 67, 69, that are "integrated" with the at least one injection tube 65, as shown in FIG. 4. For some applications the inventive injectable tie back cover tubing 50, could be a one-piece unit 50, comprising of the feeder tubes 62, 64, at each end of the at least one injection tube 65. For some applications the inventive injectable tie back cover tubing 50, could be a one-piece unit 50, comprising of the feeder tubes 62, 64, at each end of the at least one injection tube 65, and wherein each of the tubes 62, 64, 65, could be made of the same material or a different material. It should be understood that the at least one injection tube 65, or injectable tubing 65, having a plurality of openings 66, could be made from a porous material 65, and wherein the porous tubing material 65, would provide porous openings 66, instead of a discrete opening 66. The injection tube or hose 65, could be made of a porous material 65A, such as, for example, porous foam 65A, porous plastic 65A, porous rubber 65A, porous polymer 65A, porous composite 65A, and combinations thereof, to name a few, having porous openings 66. For some applications the injection tube or hose 65, could be made of a plastic material 65A, or a rubber material 65A, or a metallic material 65A, or a composite material 65A, and combinations thereof, to name a few, which would have a plurality of openings 66, such as, for example, slits 66, cuts 66, holes 66, gaps 66, and combinations thereof, to name a few, to allow the flow of at least one secondary sealant material 71, such as, for example, grout 71, to ooze or discharge out of the openings 66, and into the crack or void 61, especially along the length of the injection hose or tube 65, around the dome channel. It should be understood that the openings 66, such as, for example, slits 66, cuts 66, holes 66, gaps 66, to name a few, in the injection tube or hose 65, should be such that these openings 66, don't allow the passage of concrete 60, or shotcrete 60, to enter inside the injection tube or hose 65, and clog or block the injection tube or hose 65, so as to prevent or block the passage or insertion of the secondary sealant material 71, via the injection tube or hose 65.

Figure 6:
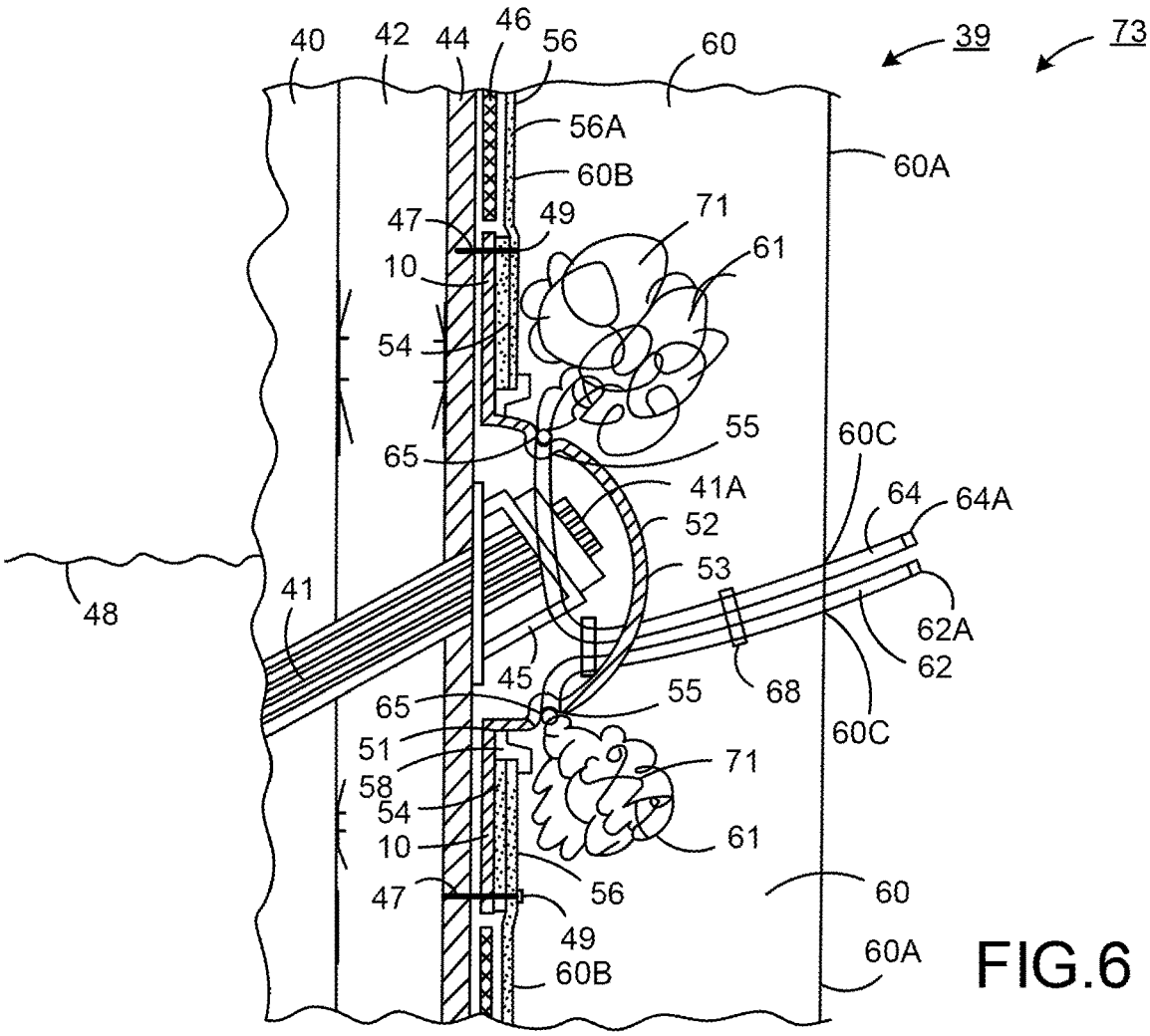
FIG. 6, illustrate a side view of an inventive injectable tie back cover according to a sixth embodiment of the invention, after being secured to a wall, and the application of shotcrete or concrete, and being injected with at least one secondary sealing material.

FIG. 6, illustrate a side view of an inventive injectable tie back cover 53, according to a sixth embodiment 73, of the invention, after being secured to a wall 39, and the application or placement of concrete 60, or shotcrete 60, and being injected with at least one second or supplemental or secondary sealing material 71. As shown in FIG. 6, after the concrete 60, or shotcrete 60, has been applied to the wall 39, and the concrete 60, or shotcrete 60, has cured, one discovers that the wall 39, has developed one or more crack 61, or opening 61, which is allowing water 48, or moisture 48, to seep or creep through the wall 39, and present itself along the outer or exposed surface 60A, of the concrete 60, or shotcrete 60. Thus, in order to do the repairs at this point the choice would be to remove the concrete 60, or shotcrete 60, which would be very expensive, and time consuming, or to somehow repair the cracks 61, or voids 61, which are usually a temporary fix, or to use the current invention, which is to inject a second or secondary or supplemental sealant 71, into the hidden crack 61, or void 61. Thus, now that the concrete 60, or shotcrete 60, has been cured, one can either inject a secondary sealant 71, right away, or wait until a secondary sealant 71, is needed. When needed the secondary sealant 71, would be injected into the wall 39, using the open tube end 62A, or 64A, of either feeder tube 62, or feeder tube 64. For example, one could take the open end 62A, of the feeder tube 62, and using pressure, inject secondary sealant 71, so that the secondary sealant 71, is pushed towards, and into the injectable tubing 65, and so if there are any cracks or voids 61, in the concrete 60, or shotcrete 60, or around the inventive injectable tie back cover 53, the secondary sealant 71, would seep out or get pushed out via the several openings 66, into the voids 61, or cracks 61, and thus would provide or act as a secondary waterproofing sealant 71. Any excess amount of the secondary sealant 71, would eventually come out of the open end 64A, of the second feeder tube 64. Once the secondary sealant 71, has been successfully placed inside the void 61, or crack 61, the feeder tubes 62, 64, are no longer needed or can be used, and so in that eventuality one would either trim the excess ends 62A, 64A, of the feeder tubes 62, 64, respectively, that are sticking out of the planar surface 60A, of the concrete 60, or shotcrete 60, or the excess ends 62A, 64A, of the feeder tube 62, 64, could be covered (not shown), or hidden (not shown), or the excess ends 62A, 64A, of the feeder tube 62, 64, could be left as is, as shown in FIG. 6. It should be appreciated that FIG. 6, is similar to FIG. 4, however, in FIG. 6, one sees cracks or voids 61, that have developed in the concrete 60, or shotcrete 60, and which must be filled in order to prevent the water 48, or moisture 48, from seeping in through the wall 39, and onto the outer surface 60A, of the concrete 60, or shotcrete 60. Because the user has already placed the inventive injectable tie back cover 73, along with the inventive injectable tie back cover tubing 50, inside the concrete 60, or shotcrete 60, and so all one has to do is to inject secondary sealant material 71, via one of the feeder tube 62, 64, and then under pressure the injected secondary sealant material 71, would ooze or seep out of the openings or cracks 66, in the injection tube 65, and fill any cracks or voids 61. Thus, as one can appreciate that the inventive solid hollow dome 53, not only provides protection to any uneven surface, such as, caused by a construction item 45, such as, for example, at least one tieback nut or bolt 45, but also provides a designated surface or channel 55, which accommodates at least a portion of at least one injection tube 65, having at least one radial opening 66, for the passage of at least one secondary sealant material 71.

Figure 7:
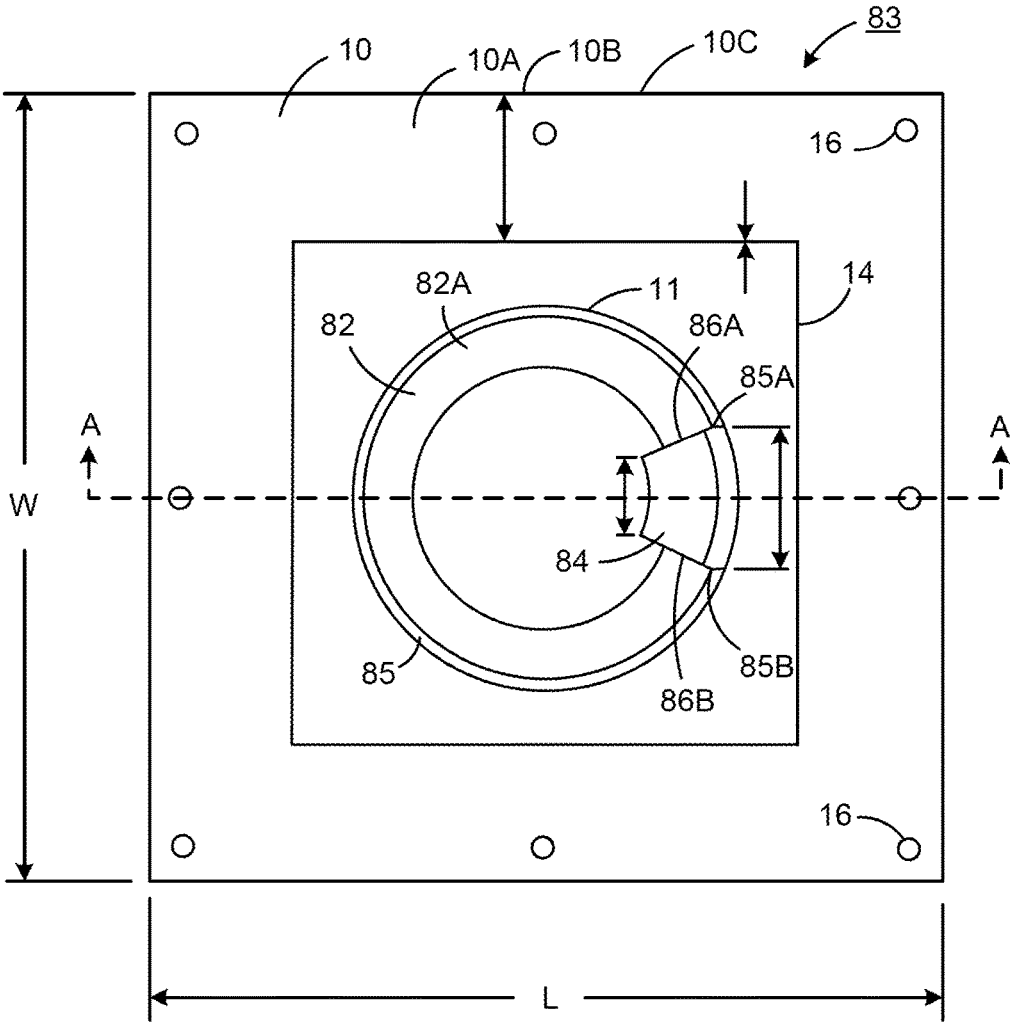
FIGS. 7, 8, and 9, illustrate a top, side, and perspective view, respectively, of an inventive injectable tie back cover, according to a seventh embodiment of the invention.
Figure 8:
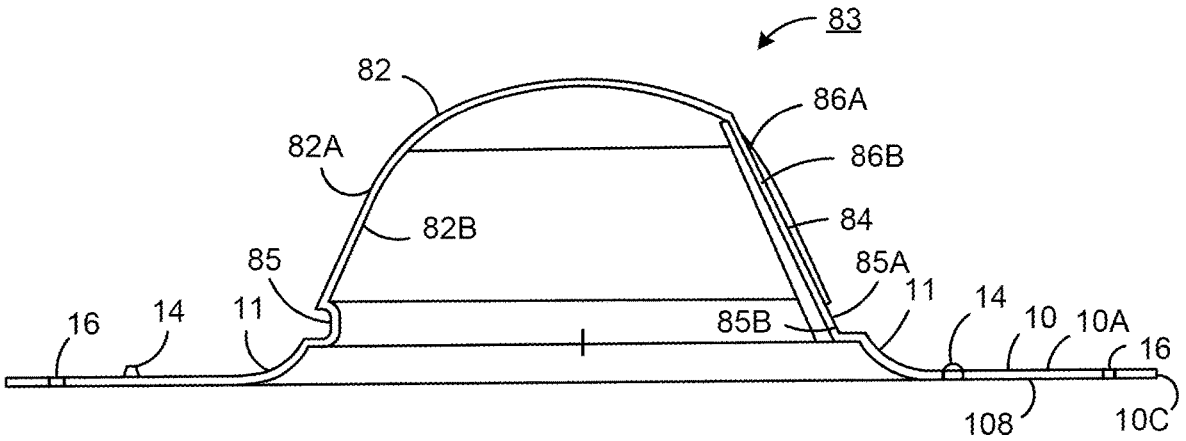
Figure 9:
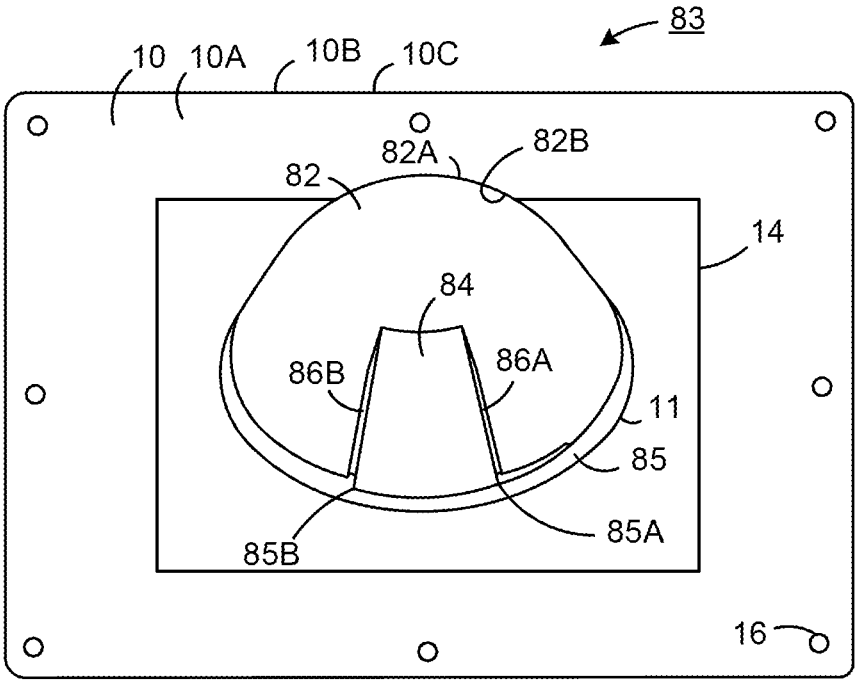

FIGS. 7, 8, and 9, illustrate a top, side, and perspective view, respectively, of an inventive injectable tie back cover 83, according to a seventh embodiment of the invention. FIG. 8, is taken along line AA, from FIG. 7. The inventive injectable tie back cover 83, comprises of a substantially flat base 10, having a first or upper or top base surface 10A, a second or bottom base surface 10B, a polygonal base edge 10C, and having a substantially hollow dome 82, connected to the flat base 10, around an area 11, or dome base 11. The substantially hollow dome 82, has a first or an outer surface 82A, and a second or an inner surface 82B. For most applications it is preferred that the substantially hollow dome 82, around an area 11, or dome base 11, is connected to the top surface 10A, and the bottom surface 10B, and projecting substantially in an outward or upward direction. For some applications it is preferred that the flat base 10, has a plurality of openings or holes 16, preferably along the peripheral edges of the flat base 10, so as to secure the inventive injectable tie back cover 83, to another structure, such as, for example, wood lagging 42, and/or retainer 44, shown in FIG. 3. For most applications it is preferred that the hollow dome 82, has a height H, diameter D, and is substantially at the center of the flat base 10. The hollow dome 82, has at least one dome gutter 85, or dome channel 85, on the outer surface 82A, of the hollow dome 82. For some applications the flat base 10, could also have at least one mini-wall 14, or protrusion 14, between the base edge 10C, and the dome base 11. The inventive injectable tie back cover 83, further has a flat part 84, or trapezoid part 84, or an indented flat surface 84, and because this flat part 84, is projected in an inward direction it creates a first sidewall 86A, and a second sidewall 86B. For most applications the flat part 84, starts around the base area 11, or the dome channel 85, and ends around near the upper or apex portion of the dome 82. The flat part 84, is utilized as a flat surface 84, or table 84, for the resting of the elbows 67, 69, and the tail ends 62B, 64B, of the feeder tubes 62, 64, respectively. The flat part 84, or flat surface 84, along with the two side walls 86A, 86B, provides a resting place for the elbows 67, 69, and tubes 62, 64, and also to help prevent the slipping, and sliding of the elbows 67, 69, and/or the feeder tubes 62, 64, while the concrete 60, or shotcrete 60, is being applied or placed at the wall 39. For some applications the dome channel 85, could have a first termination point 85A, and a second termination point 85B, and where the termination point 85A, would terminate along the first side wall 86A, and the termination point 85B, would terminate along the second side wall 86B.

Figure 10:
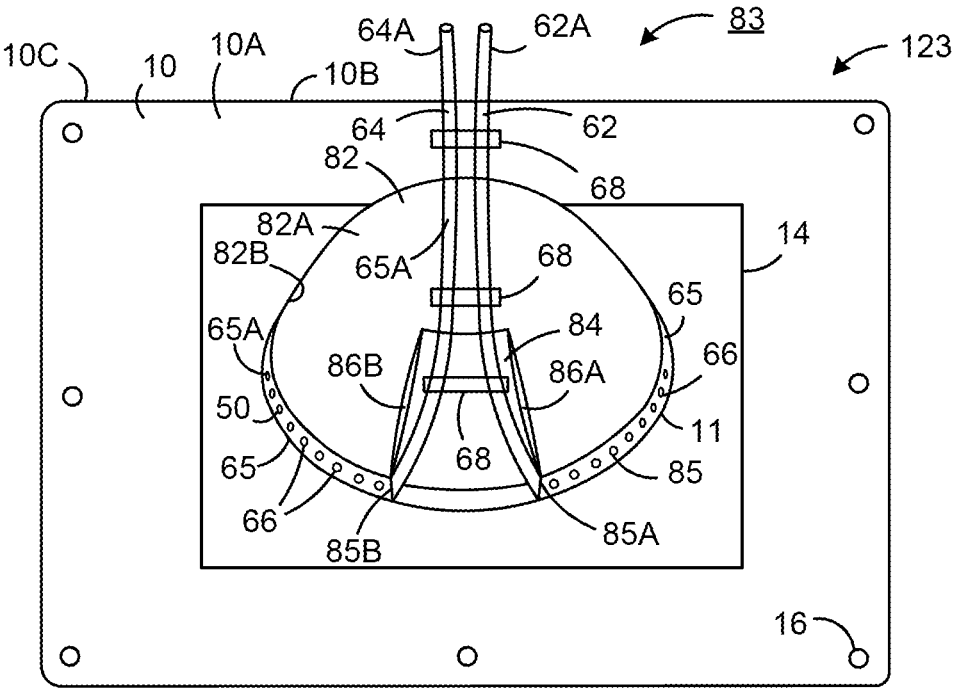
FIG. 10, illustrate a perspective view of an inventive injectable tie back cover, according to an eighth embodiment of the invention further showing the inventive injectable tie back cover tubing in place.

FIG. 10, illustrate a perspective view of an inventive injectable tie back cover 123, according to an eighth embodiment of the invention further showing the inventive injectable tie back cover tubing 50, in place. The inventive injectable tie back cover 123, is similar to the inventive injectable tie back cover 83, as illustrated in FIGS. 7, 8, and 9, except it also illustrates how the inventive injectable tie back cover tubing 50, is securely secured into the at least one dome channel 85, and where the feeder tubes 62, 64, are tied together using at least one tie 68, such as, a zip-tie 68. The hollow dome 82, has at least one dome gutter 85, or dome channel 85, on the outer surface 82A, of the hollow dome 82. For some applications the base 10, could also have at least one mini-wall 14, or protrusion 14, between the base edge 10C, and the dome base 11. The inventive injectable tie back cover 123, further has a flat part 84, or trapezoid part 84, or an indented flat surface 84, and because this flat part 84, is projected in an inward direction it creates a first sidewall 86A, and a second sidewall 86B. For most applications the flat part 84, starts around the base area 11, or the dome channel 85, and ends around near the upper or apex portion of the dome 82. The flat part 84, is utilized as a flat surface 84, or table 84, for the resting of the elbows 67, 69, and the tube tail ends 62B, 64B, of the feeder tubes 62, 64, respectively. For some applications the flat part 84, is utilized as a flat surface 84, or table 84, for the resting of the first tube end 65A, the second tube end 65B, of the at least one injection tube 65, that are joined or mated with the tube tail ends 62B, 64B, of the feeder tubes 62, 64, respectively. The flat part 84, or flat surface 84, along with the two side walls 86A, 86B, help prevent the slipping, and sliding of the elbows 67, 69, and/or the feeder tubes 62, 64, or the tube ends 65A, 65B, 62B, 64B. For some applications the dome channel 85, could have a first termination point 85A, and a second termination point 85B, and where the termination point 85A, could terminate along the first side wall 86A, and the termination point 85B, could terminate along the second side wall 86B. As one can see that the two feeder tubes 62, 64, have been tied together at several places using at least one tie 68, so that the two feeder tubes 62, 64, stay together, while the inventive injection tube 65, fits snugly, or is secured around the at least one dome channel 85. The tube ends 62A, 64A, of the two feeder tubes 62, 64, can now be positioned to stay together, and can be properly positioned during any subsequent operation, such as, for example, not to get buried during, for example, the application of concrete 60, or shotcrete 60. To prevent any concrete 60, or shotcrete 60, or any other contamination from entering the open ends 62A, 64A, of the feeder tube 62, 64, one could wrap a temporary tape or protection means (not shown), at the open ends 62A, 64A, which would be removed, when needed.

Figure 11:
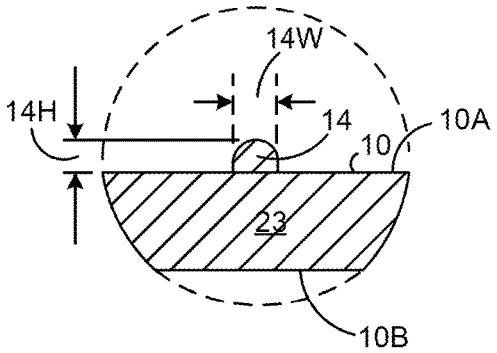
FIG. 11, illustrate an enlarged cross-sectional side view of the inventive mini-wall, as illustrated in FIGS. 1A, 1B, 1C, 7, 8, and 9, according to the various embodiments of the invention.

FIG. 11, illustrate an enlarged cross-sectional side view of the inventive mini-wall 14, as illustrated in FIGS. 1A, 1B, 1C, 7, 8, and 9, according to the various embodiments of the invention. The inventive mini-wall 14, or ledge 14, or indentation 14, is preferably made between the base edge 10C, and the dome base 11. The mini-wall 14, could have a wall height 14H, and a wall width 14W. The cross-sectional profile of the mini-wall 14, could be selected from a group comprising an elliptical profile, a circular profile, a round profile, a square profile, a rectangular profile, a triangular profile, a polygonal profile, and combinations thereof, to name a few.

Figure 12:
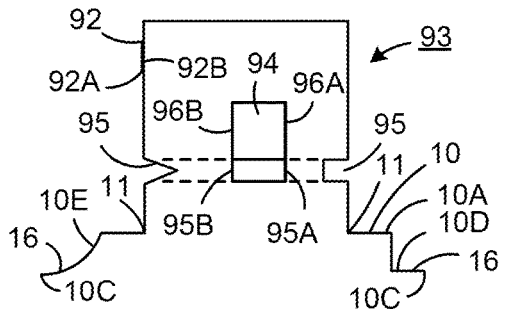
FIG. 12, illustrate a side view of an inventive injectable tie back cover, according to a ninth embodiment of the invention.

FIG. 12, illustrate a side view of an inventive injectable tie back cover 93, according to a ninth embodiment of the invention. The inventive injectable tie back cover 93, comprises of a base 10, having a first or upper or top base surface 10A, a second or bottom base surface 10B, a base edge 10C, and having a substantially hollow dome 92, connected to the base 10, around an area 11, or dome base 11. The substantially hollow dome 92, has a first or an outer surface 92A, and a second or an inner surface 92B. For most applications it is preferred that the substantially hollow dome 92, around an area 11, or dome base 11, is connected to the top surface 10A, and the bottom surface 10B, and projecting substantially in an outward or upward direction. For some applications it is preferred that the base 10, has a plurality of openings or holes 16, preferably along the peripheral edges of the base 10, so as to secure the inventive injectable tie back cover 93, to another structure, such as, for example, wood lagging 42, and/or retainer 44, shown in FIG. 3. For most applications it is preferred that the hollow dome 92, has a diameter D, height H, and is substantially at the center of the base 10. The hollow dome 92, has at least one dome gutter 95, or dome channel 95, on the outer surface 92A, of the hollow dome 92. For some applications the base 10, could also have at least one mini-wall 14, or protrusion 14, between the base edge 10C, and the dome base 11. The inventive injectable tie back cover 93, further has a flat part 94, or trapezoid part 94, or an indented flat surface 94, and because this flat part 94, is projected in an inward direction it creates a first sidewall 96A, and a second sidewall 96B. For most applications the flat part 94, starts around the base area 11, or the dome channel 95, and ends around near the upper or apex portion of the dome 92. The flat part 94, is utilized as a flat surface 94, or table 94, for the resting of the elbows 67, 69, and the tube tail ends 62B, 64B, of the feeder tubes 62, 64, respectively. The flat part 94, or flat surface 94, along with the two side walls 96A, 96B, help prevent the slipping, and sliding of the elbows 67, 69, and/or the feeder tubes 62, 64. For some applications the dome channel 95, could have a first termination point 95A, and a second termination point 95B, and where the termination point 95A, could terminate along the first side wall 96A, and the termination point 95B, could terminate along the second side wall 96B. For some applications the surface 10, could have a unique edge, and wherein the unique edge could have at least one step surface 10D, or a slope slide surface 10E, which could be below the planar surface of the base surface 10. As one can appreciate that the cross-sectional shape of the inventive dome 92, is substantially polygonal or square, or rectangular.

Figure 13:
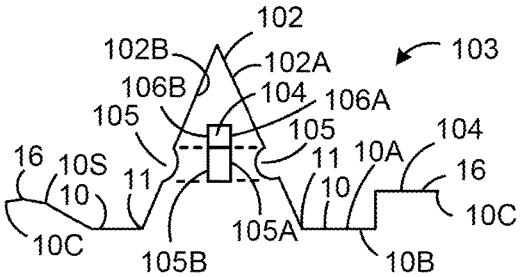
FIG. 13, illustrate a side view of an inventive injectable tie back cover, according to a tenth embodiment of the invention.

FIG. 13, illustrate a side view of an inventive injectable tie back cover 103, according to a tenth embodiment of the invention. The inventive injectable tie back cover 103, comprises of a base 10, having a first or upper or top base surface 10A, a second or bottom base surface 10B, a base edge 10C, and having a substantially hollow dome 102, connected to the base 10, around an area 11, or dome base 11. The substantially hollow dome 102, has a first or an outer surface 102A, and a second or an inner surface 102B. For most applications it is preferred that the substantially hollow dome 102, around an area 11, or dome base 11, is connected to the top surface 10A, and the bottom surface 10B, and projecting substantially in an outward or upward direction. For some applications it is preferred that the base 10, has a plurality of openings or holes 16, preferably along the peripheral edges of the base 10, so as to secure the inventive injectable tie back cover 103, to another structure, such as, for example, wood lagging 42, and/or retainer 44, shown in FIG. 3. For most applications it is preferred that the hollow dome 102, has a diameter D, height H, and is substantially at the center of the base 10. The hollow dome 102, has at least one dome gutter 105, or dome channel 105, on the outer surface 102A, of the hollow dome 102. For some applications the base 10, could also have at least one mini-wall 14, or protrusion 14, between the base edge 10C, and the dome base 11. The inventive injectable tie back cover 103, further has a flat part 104, or trapezoid part 104, or an indented flat surface 104, and because this flat part 104, is projected in an inward direction it creates a first sidewall 106A, and a second sidewall 106B. For most applications the flat part 104, starts around the base area 11, or the dome channel 105, and ends around near the upper or apex portion of the dome 102. The flat part 104, is utilized as a flat surface 104, or table 104, for the resting of the elbows 67, 69, and the tube tail ends 62B, 64B, of the feeder tubes 62, 64, respectively. The flat part 104, or flat surface 104, along with the two side walls 106A, 106B, help prevent the slipping, and sliding of the elbows 67, 69, and/or the feeder tubes 62, 64. For some applications the dome channel 105, could have a first termination point 105A, and a second termination point 105B, and where the termination point 105A, could terminate along the first side wall 106A, and the termination point 105B, could terminate along the second side wall 106B. For some applications the surface 10, could have a unique edge, and wherein the unique edge could have at least one step surface 10U, or a slope surface 10S, which could be above the planar surface of the base surface 10. As one can appreciate that the cross-sectional shape of the inventive dome 102, is triangular, or pyramidical or conical shape.

Figure 14:
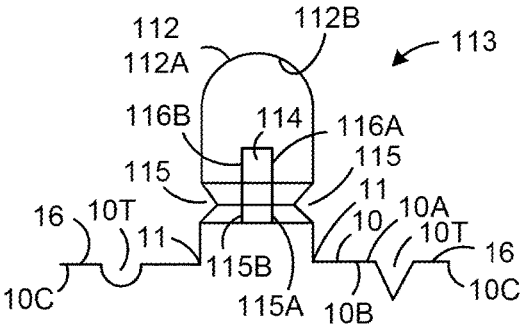
FIG. 14, illustrate a side view of an inventive injectable tie back cover, according to an eleventh embodiment of the invention.

FIG. 14, illustrate a side view of an inventive injectable tie back cover 113, according to an eleventh embodiment of the invention. The inventive injectable tie back cover 113, comprises of a base 10, having a first or upper or top base surface 10A, a second or bottom base surface 10B, a base edge 10C, and having a substantially hollow dome 112, connected to the base 10, around an area 11, or dome base 11. The substantially hollow dome 112, has a first or an outer surface 112A, and a second or an inner surface 112B. For most applications it is preferred that the substantially hollow dome 112, around an area 11, or dome base 11, is connected to the top surface 10A, and the bottom surface 10B, and projecting substantially in an outward or upward direction. For some applications it is preferred that the base 10, has a plurality of openings or holes 16, preferably along the peripheral edges of the base 10, so as to secure the inventive injectable tie back cover 113, to another structure, such as, for example, wood lagging 42, and/or retainer 44, shown in FIG. 3. For most applications it is preferred that the hollow dome 112, has a height H, diameter D, and is substantially at the center of the base 10. The hollow dome 112, has at least one dome gutter 115, or dome channel 115, on the outer surface 112A, of the hollow dome 112. For some applications the base 10, could also have at least one mini-wall 14, or protrusion 14, between the base edge 10C, and the dome base 11. The inventive injectable tie back cover 113, further has a flat part 114, or trapezoid part 114, or an indented flat surface 114, and because this flat part 114, is projected in an inward direction it creates a first sidewall 116A, and a second sidewall 116B. For most applications the flat part 114, starts around the base area 11, or the dome channel 115, and ends around near the upper or apex portion of the dome 112. The flat part 114, is utilized as a flat surface 114, or table 114, for the resting of the elbows 67, 69, and the tube tail ends 62B, 64B, of the feeder tubes 62, 64, respectively. The flat part 114, or flat surface 114, along with the two side walls 116A, 116B, help prevent the slipping, and sliding of the elbows 67, 69, and/or the feeder tubes 62, 64. For some applications the dome channel 115, could have a first termination point 115A, and a second termination point 115B, and where the termination point 115A, could terminate along the first side wall 116A, and the termination point 115B, could terminate along the second side wall 116B. For some applications the surface 10, could have a unique edge, and wherein the unique edge could have at least one surface having at least one channel surface or trench surface 10T, which would be below the planar surface of the base surface 10. As one can appreciate that the cross-sectional shape of the inventive dome 112, is substantially circular, or round, or elliptical shape.

The base diameter 11, for the inventive dome 12, 32, 52, 82, 92, 102, 112, for the inventive injectable tie back cover 23, 33, 53, 63, 73, 83, 93, 103, 113, could be between about 4 inches to about 20 inches, and more preferably between about 6 inches to about 12.

The inventive dome 12, 32, 52, 82, 92, 102, 112, for the inventive injectable tie back cover 23, 33, 53, 63, 73, 83, 93, 103, 113, has been shown as having a circular base 11, however, the dome could also have an elliptical base 11, a square base 11, a rectangular base 11, a polygonal base 11, and combinations thereof, to name a few.

The inventive dome 12, 32, 52, 82, 92, 102, 112, for the inventive injectable tie back cover 23, 33, 53, 63, 73, 83, 93, 103, 113, has been shown to have a substantially truncated cone shape, but the cross-sectional shape for the inventive dome 12, 32, 52, 82, 92, 102, 112, could be selected from a group comprising a square shape, a rectangular shape, a polygonal shape, a conical shape, a pyramid shape, a triangular shape, a round shape, an elliptical shape, and combinations thereof, to name a few.

The inventive dome 12, 32, 52, 82, 92, 102, 112, for the inventive injectable tie back cover 23, 33, 53, 63, 73, 83, 93, 103, 113, could have at least one dome channel 15, 55, 85, 95, 105, 115, which could have a cross-sectional shape, which cross-sectional shape could be selected from a group comprising a round shape, a semi-circular shape, a semi-elliptical shape, a triangular shape, a square shape, a rectangular shape, a multi-sided shape, and combinations thereof, to name a few.

The material for the inventive injectable tie back cover 23, 33, 53, 63, 73, 83, 93, 103, 113, could be selected from a group comprising an ABS (Acrylonitrile Butadiene Styrene) material, a plastic material, a polymeric material, a PTFE (polytetrafluoroethylene) material, a metallic material, a composite material, and combinations thereof, to name a few. It should be appreciated that the inventive injectable tie back cover 23, 33, 53, 63, 73, 83, 93, 103, 113, should be made with a heavy-duty, high-impact material which can resist, for example, construction traffic, concrete/shotcrete placement or application, to name a few.

For some applications the secondary sealant 71, that is injected into the cracks or voids 61, via the at least one injection tube 65, could be selected from a group comprising a polyurethane hydrophilic material or grout, a hydrophobic material or grout (often referred to as chemical grout), a hydrophilic material or grout, a resin material, and combinations thereof, to name a few. Because of the materials involved one would normally not try to push a sealant through the feeder tubes 62, 64. It should be appreciated that hydrophilic polyurethanes 71, naturally mixes with water before curing (similar to the way gin and tonic mix thoroughly in a glass). This characteristic of the hydrophilic polyurethanes 71, allows for a very strong chemical, and mechanical bond, as water helps pull the material 71, into the pores or cracks 61, of the concrete 60, or shotcrete 60. It should be appreciated that hydrophilic grouts 71, are recommended for areas or cracks 61, that are constantly wet 48, because they bond better to wet concrete 60, or shotcrete 60. They are water loving grouts 71, which means they thrive in moist environments 48. It has been observed that hydrophilic grouts 71, perform very well when they are subjected to water 48, 24 hours a day. However, if the water 48, goes away, hydrophilic grouts 71, are not ideal because they could shrink and crack when the crack area 61, dries out, as it could potentially leak all over again on the next rain or moisture event, or due to the returning of the water table 48. This is called a wet/dry situation, which means that the water 48, can be present in a crack or void 61, after a hard rain, and then a few days later when water 48, is no longer present in the crack and void 61, and the water table 48, drops or the weather dries out, and then the cracks or voids 61, have no moisture 48, present, in such situations one could use a hydrophobic grout 71. Essentially, hydrophilic grouts 71, retain water after curing, while hydrophobic grouts 71, are void of water after curing. Some manufacturers, and applicators recommend using only hydrophobic grouts 71, in wet-dry conditions, but others suggest that hydrophilic resins 71, performs well if one limits the water-resin ratio.

For some applications the secondary sealant 71, could be injected, if needed or required, into the cracks or voids 61, after the concrete/shotcrete 60, has been placed or formed, as follows:

(a) One would inject water into one tube end 62A, 64A, of the feeder tube 62, 64, and this injection would continue until water comes out the other tube end 64A, 62A. This is done basically to confirm that the injection tube 65, is not clogged.

(b) The user or applicator would then clamp one end, for example, the tube end 64A, of the feeder tube 64, and continue to inject water into the injection tube 65, using the tube end 62A, of the feeder tube 62, until the user or the applicator sees the water coming through the cracks or voids 61, in the concrete 60, or shotcrete 60, along the surface 60A, of the concrete 60, or shotcrete 60.

(c) The user or applicator would then remove the clamp(s) from the tube end 64A, and the secondary sealant 71, or chemical grout 71, would be injected into the injection tube 65, via one end of tube end 62A, 64A, of the feeder tube 62, 64, until the sealant or grout 71, starts to come out of the other end 62A/64A, of the feeder tube 62, 64.

(d) For some applications the clamp(s) could be put back on the tube end 62A, 64A, of the feeder tube 62, 64, and then the injection of the grout 71, would be started or turned back on again, and one could slowly increase the pressure of the injection of the grout 71, that is being pushed into or through the cracks or voids 61. The grout 71, could also include at least one activator that could be used to control the time in which it takes for the chemical grout 71, to foam, and/or seal the voids or cracks 61, in the concrete 60, or shotcrete 60.

(e) Once the grout 71, has been pushed through or into the cracks or voids 61, the user or applicator would turn off the injection of the grout 71, and the clamp(s) would be removed from the tube end 62A, 64A. For some applications, the tube ends 62A, 64A, of the feeder tubes 62, 64, could be cut flush parallel to the concrete face or surface 60A, and one could then hide the holes 60C, or tube ends 62A, 64A, using at least one cementitious grout along the face or surface 60A. However, for some applications the tube ends 62A, 64A, of the feeder tubes 62, 64, could be left in situ, if surface aesthetic is not an issue.

EXAMPLE

In this example the user is using a 6 inch diameter inventive injectable tie back cover 23, 33, 43, 53, 63, 73, 83, 93, 103, 113. So for a 6 inch diameter inventive injectable tie back cover 23, 33, 43, 53, 63, 73, 83, 93, 103, 113, one would cut a piece of the skin membrane 56, such as, Aussie Skin 56, approximately 30 inches by 30 inches, and then mark a box, such as, a square box, for example, a 15 inches square box in the center of the skin membrane 56. The marked box can be of any shape as long as it can go over the dome 12, 32, 52, 82, 92, 102, 112. For most applications one would cut either a substantially round box, or a substantially square box, or a substantially rectangular box, to name a few. One would then cut out the center 15 inch center square hole in the skin membrane 56. The next step would be to hang or secure the 6 inch inventive injectable tie back cover 23, 33, 43, 53, 83, 93, 103, 113, over the tie back head 41A, area, such as, by using at least one securing means 47, so as to secure the 6 inch inventive injectable tie back cover 23, 33, 43, 53, 83, 93, 103, 113, to the wall 39. For the 6 inch inventive injectable tie back cover 23, 33, 43, 53, 83, 93, 103, 113, that has a flat or trapezoid section, one would then place the 6 inch inventive injectable tie back cover 23, 33, 43, 53, 83, 93, 103, 113, over the tie back head 41A, such that the flat or trapezoid section in the dome 12, 32, 52, 82, 92, 102, 112, preferably faces up, so that the feeder tubes 62, 64, could rest or stay over the flat or trapezoid section 84. One would then set or place the skin membrane 56, over the 6 inch inventive injectable tie back cover 23, 33, 43, 53, 83, 93, 103, 113, to make sure that it fits properly through the dome 12, 32, 52, 82, 92, 102, 112, and on the upper surface 10A. For an inventive injectable tie back cover 23, 33, 43, 53, 83, 93, 103, 113, with a marker 14, such as, a square marker 14, one would make sure that the skin membrane 56, material does not cover the square marker line on the inventive injectable tie back cover 23, 33, 43, 53, 83, 93, 103, 113. One would then apply at least one double sided tape 54, to the upper surface 10A, of the inventive injectable tie back cover 23, 33, 43, 53, 83, 93, 103, 113, at at least one location. It is preferred that the double-sided tape 54, touches the square marker 14, on the upper surface 10A, of the inventive injectable tie back cover 23, 33, 43, 53, 83, 93, 103, 113. For most applications one would continue to apply the double-sided tape 54, to all four sides of the inventive injectable tie back cover 23, 33, 43, 53, 83, 93, 103, 113. One would then set or place the piece of the skin membrane 56, over the dome 12, 32, 52, 82, 92, 102, 112, and onto the double-sided tape 54. For a better adhesion or bond, one could use a pressure roller (not shown), such as, a steel roller, to ensure proper adhesion between the bottom surface 56B, of the skin membrane 56, and the top surface 10A, of the inventive injectable tie back cover 23, 33, 43, 53, 83, 93, 103, 113. It is preferred that one marks the skin membrane 56, approximately 1 inch from edge 10C. One could then apply the first or primary sealant 58, such as, for example, Aussie Seal M sealant 58, about 1 inch onto the skin membrane 56, and about 1 inch from the dome base edge 10C, and onto the top surface 10A, of the dome base 10. It is preferred that one spreads the sealant 58, with a flat tool (not shown) to ensure a complete seal between the dome's base 10, and the edges of the skin membrane 56. This would complete the installation of a 6 inch inventive injectable tie back cover over the wall 39. One would then allow the sealant 58, to fully cure before the application of the concrete 60, or shotcrete 60. The next step would be to cut a piece of the inventive injection tube 65, approximately about 31.5 inches long. One would then insert each injection tube edge or end 65A, 65B, into a separate elbow 67, 69, and one should make sure that it is pushed all the way in so as to make a good connection between the inventive injection tube ends 65A, 65B, and the two elbows 67, 69. The next step would be to set or wrap or place the inventive injection tube 65, into the groove 15, 35, 55, 85, 95, 105, 115, or channel 15, 35, 55, 85, 95, 105, 115, in the inventive injectable tie back cover 50, with the elbows 67, 69, landing on the flat part or the flat or trapezoid part of the dome 12, 32, 52, 82, 92, 102, 112. For some applications one could also secure both elbows 67, 69, together with a tie 68, such as, a zip-tie 68. The next step would be to cut two pieces of feeder hoses or tubes 62, 64, preferably a min of 6 inches longer than the thickness of the concrete 60, or shotcrete 60, that is planned to placed on the wall 39. So, for example, for a 12 inch thick concrete/shotcrete wall 60, each feeder tube or hose 62, 64, should be a minimum 18 inches long. One would then insert each feeder tube or hose 62, 64, into open end 67A, 69A, of the separate elbows 67, 69. For some applications one could secure the feeder tubes or hoses 62, 64, and/or elbows 67, 69, with at least one zip ties 68, as needed. It is recommended that the feeder tubes or hoses 62, 64, are secured to a rebar cage (not shown) such that the feeder tubes or hoses 62, 64, will stick out of the concrete wall 60, or shotcrete wall 60, once they are poured or applied. It is also recommended the one tape shuts the open edges or ends 62A, 64A, of the feeder tubes 62, 64, with a protective material, such as, for example, a masking tape (not shown) to ensure that the open ends 62A, 64A, of the feeder tubes 62, 64, stay clean of debris until concrete 60, or shotcrete 60, is poured or applied. It should be understood that it does not matter how the inventive injectable tie back cover 23, 33, 43, 53, 83, 93, 103, 113, is being oriented over the tieback head 41A, or in which orientation the two feeder tube 62, 64, are protruding out of the concrete 60, or shotcrete 60.

Thus, the present invention is not limited to the embodiments described herein and the constituent elements of the invention can be modified in various manners without departing from the spirit and scope of the invention. Various aspects of the invention can also be extracted from any appropriate combination of a plurality of constituent elements disclosed in the embodiments. Some constituent elements may be deleted in all of the constituent elements disclosed in the embodiments. The constituent elements described in different embodiments may be combined arbitrarily.

Still further, while certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions.

It should be further understood that throughout the specification and claims several terms have been used and they take the meanings explicitly associated herein, unless the context clearly dictates otherwise. For example, the phrase "in one embodiment" as used herein does not necessarily refer to the same embodiment, though it may. Additionally, the phrase "in another embodiment" as used herein does not necessarily refer to a different embodiment, although it may. Thus, various embodiments of the invention may be readily combined, without departing from the scope or spirit of the invention.

While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. An injectable tie back cover apparatus for waterproofing, comprising:

(a) a hollow dome having an outer surface, an inner surface, and a peripheral edge surface;

(b) a base having an upper surface, a lower surface, an outer peripheral edge, an internal opening having an inner peripheral edge, and wherein said inner peripheral edge of said base is secured to said peripheral edge surface of said dome;

(c) said outer surface of said hollow dome having at least one dome channel on at least a portion of said outer surface of said hollow dome; and (d) at least one skin membrane secured to at least a portion of said outer peripheral edge of said base.

2. The injectable tie back cover apparatus for waterproofing of claim 1, wherein said outer surface of said hollow dome has a surface having a first surface edge, and a second surface edge.

3. The injectable tie back cover apparatus for waterproofing of claim 1, wherein said upper surface of said base has at least one inner peripheral mini-wall.

4. The injectable tie back cover apparatus for waterproofing of claim 1, further comprising:

at least one injection tube having a first end, and a second end, and wherein at least a portion of said at least one injection tube is placed inside at least a portion of said at least one dome channel.

5. The injectable tie back cover apparatus for waterproofing of claim 1, further comprising:

at least one injection tube having a first end, and a second end, and wherein said first end is secured to a first end of a first tube elbow, and said second end is secured to a first end of a second tube elbow, and at least a portion of said at least one injection tube is placed inside at least a portion of said at least one dome channel.

6. The injectable tie back cover apparatus for waterproofing of claim 1, further comprising:

at least one injection tube having a first end, and a second end;

a first tube elbow having a first end, and a second end;

a second tube elbow having a first end and a second end;

and wherein said first end of said injection tube is secured to said first end of said first tube elbow, and said second end of said injection tube is secured to said first end of said second tube elbow, and at least a portion of said at least one injection tube is placed inside at least a portion of said at least one dome channel;

a first feeder tube having a first end, and a second end;

a second feeder tube having a first end, and a second end; and wherein said first end of said first feeder tube is secured to said second end of said first tube elbow, and said first end of said second feeder tube is secured to said second end of said second tube elbow.

7. The injectable tie back cover apparatus for waterproofing of claim 1, wherein at least one injection tube having a first end and a second end is placed into a portion of said at least one dome channel, and wherein said first end is secured to a first feeder tube, and said second end is secured to a second feeder tube.

8. The injectable tie back cover apparatus for waterproofing of claim 1, wherein at least one injection tube is placed into a portion of said at least one dome channel, and wherein said at least one injection tube has at least one radial opening for the passage of at least one sealant.

9. The injectable tie back cover apparatus for waterproofing of claim 1, wherein a cross-sectional profile of said hollow dome is selected from a group consisting of a square shape, a rectangular shape, a polygonal shape, a conical shape, a pyramid shape, a triangular shape, a truncated cone shape, a round shape, an elliptical shape, and combinations thereof.

10. The injectable tie back cover apparatus for waterproofing of claim 1, wherein material for said hollow dome is selected from a group consisting of an ABS (Acrylonitrile Butadiene Styrene) material, a plastic material, a polymeric material, a PTFE (polytetrafluoroethylene) material, a metallic material, a composite material, and combinations thereof.

11. The injectable tie back cover apparatus for waterproofing of claim 1, wherein said at least one dome channel has a cross-sectional shape, which cross-sectional shape is selected from a group consisting of a round shape, a semi-circular shape, a semi-elliptical shape, a triangular shape, a square shape, a rectangular shape, a multi-sided shape, and combinations thereof.

12. The injectable tie back cover apparatus for waterproofing of claim 1, wherein said base has at least one opening for the passage of at least one securing means.

13. The injectable tie back cover apparatus for waterproofing of claim 1, wherein at least one secondary edge surface is secured to said base, and wherein said secondary edge surface is selected from a group consisting of a step surface, a slope surface, a surface having at least one trench, a surface having at least one channel, and combinations thereof.

14. The injectable tie back cover apparatus for waterproofing of claim 1, wherein at least one sealant is secured to at least a portion of said at least one skin membrane.

15. An injectable tie back cover apparatus for waterproofing for a wall, comprising:

(a) at least one soil retention system having a first face and a second face, and wherein said first face faces compacted earth or soil;

(b) a wall having a first face, and a second face, and wherein said first face of said wall is secured to at least a portion of said second face of said at least one soil retention system;

(c) a hollow dome having an outer surface, an inner surface, and a peripheral edge surface;

(d) a base having an upper surface, a lower surface, an outer peripheral edge, and an interior opening having an inner peripheral edge, and wherein said inner peripheral edge of said base is secured to said peripheral edge surface of said dome;

(e) said outer surface of said hollow dome having at least one dome channel around at least a portion of said outer surface of said hollow dome;

(f) at least one injection tube having a first end, and a second end;

(g) a first tube elbow having a first end, and a second end;

(h) a second tube elbow having a first end and a second end;

(i) a first feeder tube having a first end, and a second end;

a second feeder tube having a first end and a second end, and wherein said first end of said at least one injection tube is secured to said first end of said first tube elbow, and said second end of said at least one injection tube is secured to said first end of said second tube elbow, and at least a portion of said at least one injection tube is placed inside at least a portion of said at least one dome channel;

wherein said first end of said first feeder tube is secured to said second end of said first tube elbow, and said first end of said second feeder tube is secured to said second end of said second tube elbow; and (k) wherein at least a portion of said base is in secure contact with said second face of said wall.

16. The injectable tie back cover apparatus for waterproofing for a wall of claim 15, wherein one of concrete and shotcrete having a first face and a second face is secured to at least a portion of said second face of said wall.

17. The injectable tie back cover apparatus for waterproofing for a wall of claim 15, wherein one of concrete and shotcrete having an inner face and an outer face is secured to at least a portion of said second face of said wall, and wherein a portion of said first feeder tube, and said second feeder tube, extends beyond said outer face of said concrete and shotcrete.

18. The injectable tie back cover apparatus for waterproofing for a wall of claim 15, wherein at least one secondary sealant material is injected into said at least one injection tube via one of said second end of said first feeder tube and said second end of said second feeder tube.

19. The injectable tie back cover apparatus for waterproofing for a wall of claim 15, wherein at least one secondary sealant material is injected into said at least one injection tube via one of said second end of said first feeder tube and said second end of said second feeder tube, and wherein said at least one secondary sealant material is selected from a group consisting of a polyurethane hydrophilic material, a hydrophobic material, a chemical grout, a hydrophilic material, a resin material, and combinations thereof.

20. The injectable tie back cover apparatus for waterproofing for a wall of claim 15, wherein said at least one injection tube is placed into a portion of said at least one dome channel, and wherein said at least one injection tube has at least one radial opening for the passage of at least one sealant.

* * * * *